US010611511B1

(12) United States Patent
Kuzma et al.

(10) Patent No.: US 10,611,511 B1
(45) Date of Patent: Apr. 7, 2020

(54) SPIRALLY THREADED MOLDED BOTTLE FINISH HAVING REMOVABLE AND NONREMOVABLE CLOSURES AND CLOSURES THEREFOR

(71) Applicant: GK Packaging, Inc., Plain City, OH (US)

(72) Inventors: Gene J. Kuzma, Powell, OH (US); Tristan O. Herstol, Worthington, OH (US); Theodore R. Niswonger, Hilliard, OH (US)

( * ) Notice: Subject to any disclaimer, the term of this patent is extended or adjusted under 35 U.S.C. 154(b) by 37 days.

(21) Appl. No.: 16/173,815

(22) Filed: Oct. 29, 2018

(51) Int. Cl.
*B65D 1/02* (2006.01)
*B65D 41/04* (2006.01)

(52) U.S. Cl.
CPC ..... *B65D 1/0246* (2013.01); *B65D 41/04* (2013.01)

(58) Field of Classification Search
CPC .... B65D 1/0246; B65D 1/023; B65D 1/0223; B65D 41/0471; B65D 41/0428; B65D 41/0407
USPC ... 215/44, 43, 329, 316, 218, 217, 252, 250, 215/253; 220/293, 288, 259.3
See application file for complete search history.

(56) References Cited

U.S. PATENT DOCUMENTS

| | | | |
|---|---|---|---|
| 4,378,073 | A | 3/1983 | Luker |
| 4,464,316 | A | 8/1984 | Michaels |
| 4,736,859 | A | 4/1988 | Mayes |
| 4,892,208 | A | 1/1990 | Sledge |
| 4,913,299 | A | 4/1990 | Petro |
| 5,169,033 | A | 12/1992 | Shay |
| 5,360,127 | A | 11/1994 | Barriac |
| 6,044,992 | A | 4/2000 | Ma |
| 6,109,467 | A | 8/2000 | Schliemann |
| 7,243,807 | B2 | 7/2007 | Lin |
| 7,900,789 | B2 | 3/2011 | Johnston |
| 9,205,946 | B2 | 12/2015 | Toribio et al. |
| 2005/0109726 | A1 | 5/2005 | Alley |

FOREIGN PATENT DOCUMENTS

| | | |
|---|---|---|
| EM | 0 339 939 A3 | 2/1989 |

*Primary Examiner* — Robert J Hicks
(74) *Attorney, Agent, or Firm* — Michael J. Gallagher, Esq.; Luper Neidenthal & Logan, LPA

(57) ABSTRACT

A bottle finish and closure system is described. In some embodiments, ratchets on a finish engage ratchets on a closure, while allowing the free passage of the threads of the closure on those of the finish in one direction only, allowing a non-removable finish and closure system. In another series of embodiments, the same ratcheted finish may be employed with a non-ratcheted, i.e., conventional closure, due to the novel design of the finish ratchets, thereby producing a freely removable closure and finish system.

21 Claims, 12 Drawing Sheets

SPIRALLY THREADED MOLDED BOTTLE FINISH HAVING REMOVABLE AND NONREMOVABLE CLOSURES AND CLOSURES THEREFOR

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present disclosure relates to containers and container finishes and closures, and more particularly, to a spirally threaded molded bottle finish having a finish compatible with non-removable closures and removable closures, and closures therefor.

BACKGROUND OF THE INVENTION

Containers and container closures are manufactured with a variety of standard sizes, but may also be manufactured with custom sizes. The sizes are based on certain measurements of the container finish (100). Referring now to FIGS. 1-14, a container finish (100) and closure (300) are shown. The finish (100) has finish threads (110) on its outer wall. A finish (100) has an inside diameter, referred to as the "I" dimension, an outside finish diameter at the base of the threads, referred to as the finish "E" dimension, and an outside finish thread diameter, referred to as the finish "T" dimension. The dimensional terminology is reversed for the closure (300) with an inside closure diameter, referred to as the closure "T" dimension, and an inner thread diameter, referred to as the closure "E" dimension, as seen in FIG. 7. The closure (300) must mate with the finish (100) properly in order to provide a seal. A number of different types of seals between finishes (100) and closures (300) are available including, but not limited to, plug seals, land seals using a bead, and land seals using an edge of material. Plug seals and land seals using a bead require proper alignment between the finish (100) and the closure (300). This proper alignment is achieved by controlling the "E" and "T" dimensions of the finish (100) and the closure (300). The T and E of a closure will be slightly larger than the corresponding T and E of the neck finish, usually by about 0.010-0.020" for clearance.

It can be seen in the prior art that the most common type of finish and closure system is one where the closure may be freely put on, and taken off, the finish. Certain applications, however, perhaps those involving situations where the contents of a container might be unusually dangerous, or where a manufacturer seeks to deter the refilling of containers, require a system wherein the closure can be freely applied to the finish, so as to facilitate prior filling, but where, once applied, the closure cannot be removed from the finish without considerable effort, usually resulting in damage to, or destruction of, the container. One skilled in the art will realize that "non-removable" is only a relative term, and is only meant to indicate a finish and closure system in which it is more difficult than usual to remove a closure from a finish that normal, and often, but not necessarily, such removal will result in damage to one or both structures. Such non-damaging removal methods shall be referred to herein as "conventional" or "ordinary" removal methods.

A common design for such removal resistant containers is to employ some sort of interlocking ratchet system, such as that seen in U.S. Pat. No. 4,913,299. Ratcheted areas or ratcheted rings are commonly placed above the threaded portion of a closure and finish system, as seen in U.S. Pat. No. 9,205,946; or below the threaded portion of a closure and finish system, as seen in U.S. Pat. No. 5,360,127.

One skilled in the art will see that such above or below arrangements lead to a necessary increase in the overall height of the finish and closure system, which for various reasons, a designer may wish to avoid.

Another solution is that where teeth of the thread of a closure or finish may dig in to the thread flank of a corresponding finish or closure, such as seen in U.S. Pat. No. 5,169,033. One skilled in the art will immediately see the drawbacks of such a system. Instead of a positive stop effect such as that produced by a ratcheted system, the system of the '033 device relies on the frictional hold between the teeth and the thread flank, an uncertain method of ensuring non-removability, at best.

The present invention, in several embodiments, is directed toward the solution of these, and other problems. Additionally, in a novel feature of many of the embodiments of the present invention, the ratcheted finish may be used with a standard, i.e., non-ratcheted closure. This would allow a manufacturer to produce both openable and non-openable containers using the same finish design, by simply changing the closure type.

SUMMARY OF THE INVENTION

In its most general configuration, the presently disclosed spirally threaded molded bottle finish having removable and non-removable closures, and closures therefor, advances the state of the art with a variety of new capabilities and overcomes many of the shortcomings of prior devices in new and novel ways. The presently disclosed spirally threaded molded bottle finish having removable and non-removable closures, and closures therefor, overcomes the shortcomings and limitations of the prior art in any of a number of generally effective configurations.

In some embodiments, ratchets on the finish engage ratchets on the closure, while allowing the free passage of the threads of a closure on those of a finish in one direction only, allowing a non-removable, again acknowledging that "non-removable" is only a relative term, finish and closure system. In another series of embodiments, the same ratcheted finish may be employed with a non-ratcheted, i.e., conventional closure, due to the novel design of the finish ratchets, thereby producing a freely removable closure and finish system. The unique placement of the finish ratchets allows for a low finish height, as well as for a reduced finish E dimension. By way of example only, and not limitation, in some embodiments, the novel designs allow a thread lead-in radius of 0.000 inches, compared with one of 0.334 inches in some prior art designs; a finish wall thickness of 0.066 inches, compared with one of 0.088 inches in some prior art designs. Again by way of example only, and not limitation, in some embodiments, the SPI thread pitch of neck finishes over 28 mm may be 6 TPI, 0.167 inch. By reducing the height of the neck finish thread to approx. 0.062 inch, the resulting space between two thread segments, approximately 0.105 inch, provides enough room to pass a standard closure thread and add a ratchet system. In possible embodiments, the utilization of a single thread versus multiple threads, and the use of a lug diameter smaller than a T dimension, further saves material. Reducing the height of the neck finish results in the use of less material in the neck finish and closure, creating a cost savings. Also, in some embodiments, the finish wall area may be reduced to a minimum wall thickness, in some cases 0.050 inch, of the preform. Reducing the wall thickness of the neck finish results in the use of less material, again creating a cost savings.

BRIEF DESCRIPTION OF THE DRAWINGS

Without limiting the scope of the present spirally threaded molded bottle finish having removable and non-removable closures, and closures therefor, claimed below and referring now to the drawings and figures:

Figure 1:
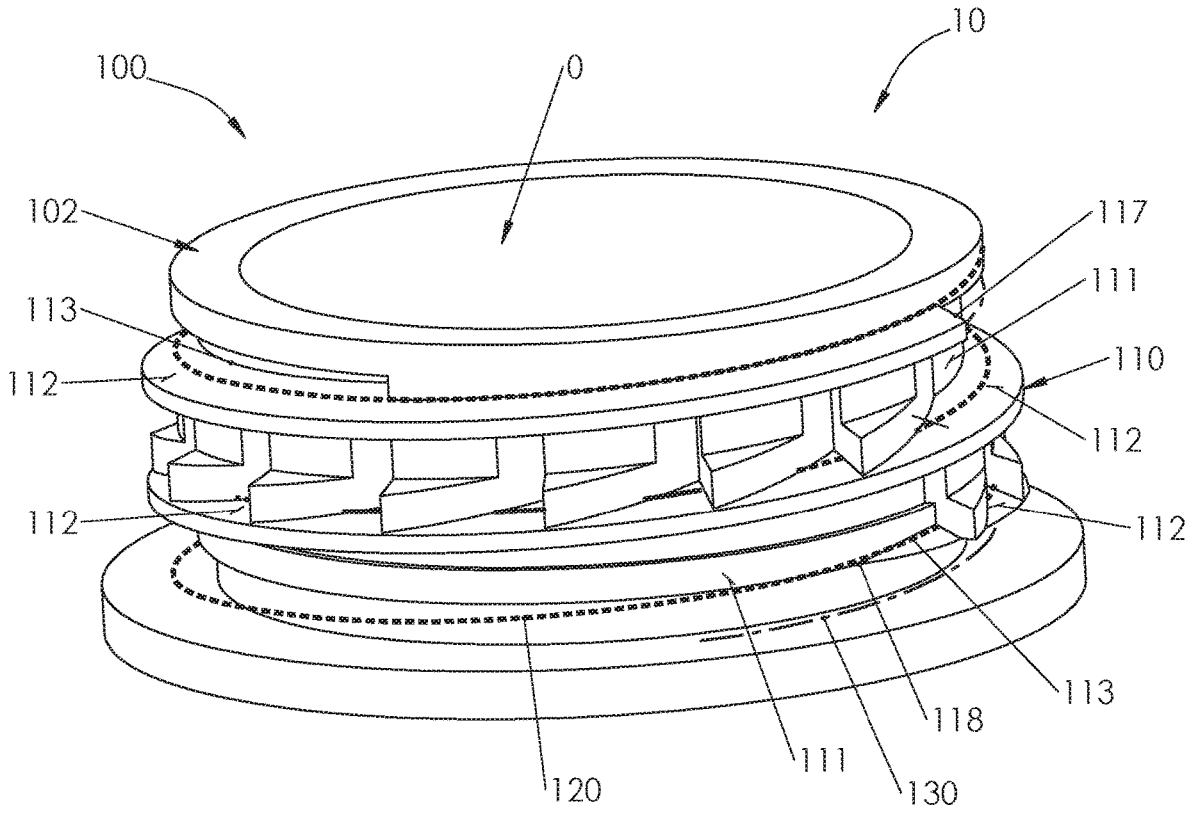
FIG. 1 is a an elevated perspective drawing of a finish according to an embodiment of the instant invention.

These drawings are provided to assist in the understanding of the exemplary embodiments of the spirally threaded molded bottle finish having removable and non-removable closures, and closures therefor as described in more detail below and should not be construed as unduly limiting the bottle neck. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The spirally threaded molded bottle finish having removable and non-removable closures, and closures therefor, hereafter referred to simply as "the system (10)", enables a significant advance in the state of the art. The preferred embodiments of the system (10) accomplish this by new and novel arrangements of elements and methods that are configured in unique and novel ways and which demonstrate previously unavailable but preferred and desirable capabilities. The description set forth below in connection with the drawings is intended merely as a description of the presently preferred embodiments of the system (10), and is not intended to represent the only form in which the system (10) may be constructed or utilized. The description sets forth the designs, functions, means, and methods of implementing the system (10) in connection with the illustrated embodiments. It is to be understood, however, that the same or equivalent functions and features may be accomplished by different embodiments that are also intended to be encompassed within the spirit and scope of the presently disclosed system (10).

Referring generally to FIGS. 1-14, what is claimed then includes, in multiple embodiments, a bottle finish and closure system (10) that may have finish and closure systems in which the closure, once threaded on the finish, is not removable using ordinary opening means, and systems in which the closure is freely and bidirectionally engageable to allow both easy closing and opening of the closure-finish system. In a first embodiment, a bottle finish (100), seen well in FIGS. 1-4, may have a finish opening (O), a finish top (102), a finish bottom (104), a finish external surface (106), a finish T dimension (FT), and a finish E dimension (FE). Again referencing FIGS. 1-4, such a finish (100), may be complementary to a bottle closure (300), having a finish thread (110) having at least one finish thread root (111), at least one first finish thread flank (112) having a first finish thread flank base (113), with the at least one second finish thread flank (114) having a second finish thread flank base (115), and at least one finish thread height (116). Such a finish thread (110) may be applied to at least an arc of a circumference of the finish external surface (106). Throughout this specification, the terms "finish T dimension," "finish E dimension," "closure T dimension," and "closure E dimension," shall have the standard meanings accorded them as are well-known in the art. An outside surface at the finish E dimension shall also be referred to herein as the finish external surface (106).

The finish thread (110), again referencing FIGS. 1-4, may have an imaginary superior finish thread border line (120) extending from the finish top (102) on the finish external surface (106), extending through a finish thread start (117), extending along the finish thread root (111) along the first finish thread flank base (113), through a finish thread termination (118), and continuously extending across any finish thread breaks (119) across the finish external surface (106) to the finish bottom (104).

Furthermore, the finish thread (110) may have an imaginary inferior finish thread border line (130) extending from the finish top (102) on the finish external surface (106), extending through the finish thread start (117), extending along the finish thread root (111) along the second finish thread flank base (115) and through the finish thread termination (118), continuously extending across any finish thread breaks (119) across the finish external surface (106) to the finish bottom (104). The concepts of the imaginary superior finish thread border line (120) and the imaginary inferior finish thread border line (130) are well illustrated in FIGS. 3-5, where the imaginary superior finish thread border line (120) is highlighted with a dark dotted line and the imaginary inferior finish thread border line (130) is highlighted with a dark broken line.

Figure 2:
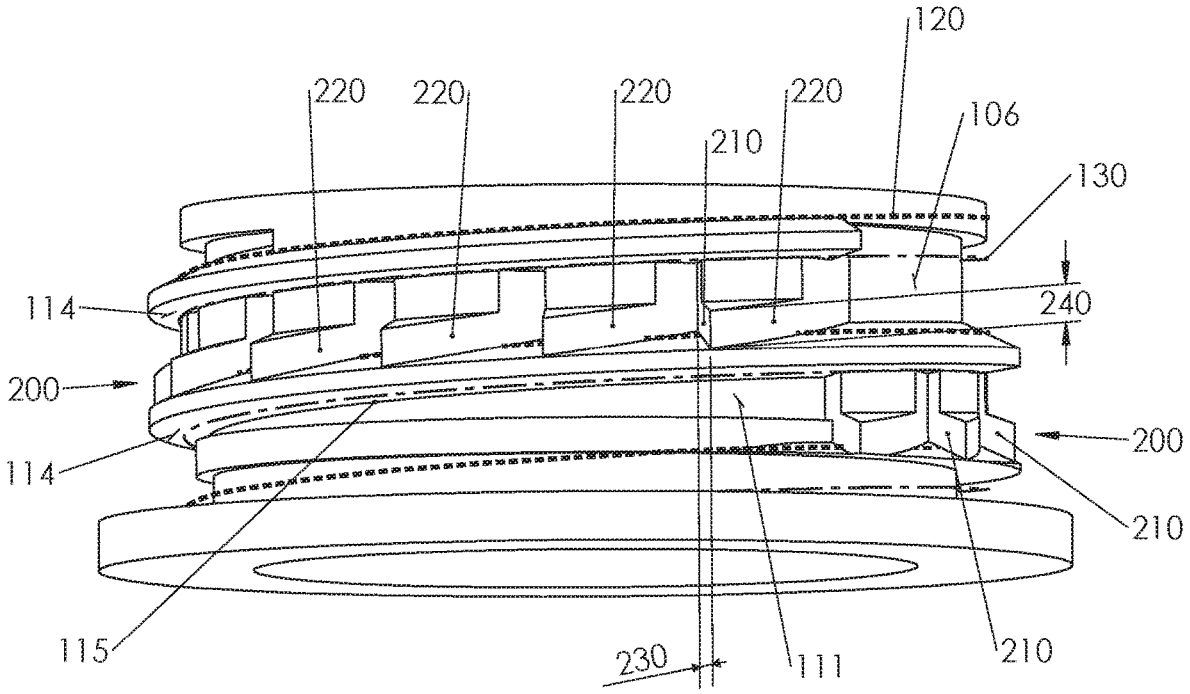
FIG. 2 is an inferior perspective drawing of a finish according to the embodiment of FIG. 1.
Figure 3:
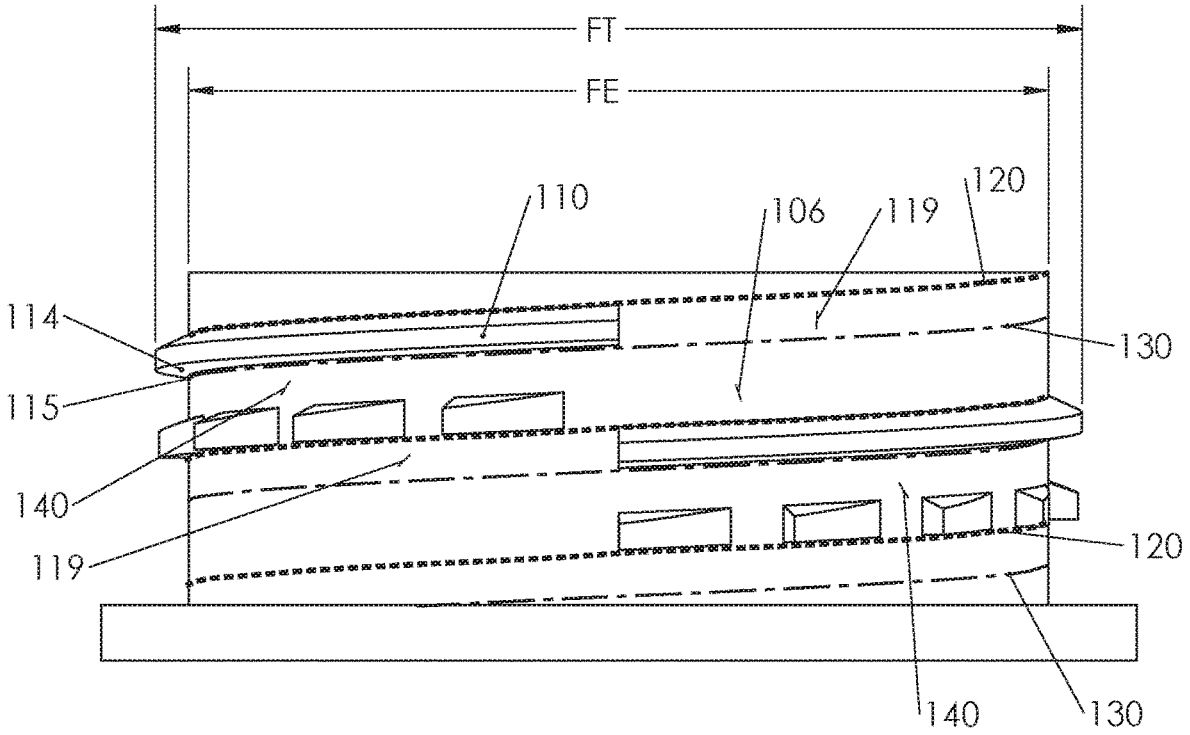
FIG. 3 is an elevation view of an embodiment of the instant invention.
Figure 4:
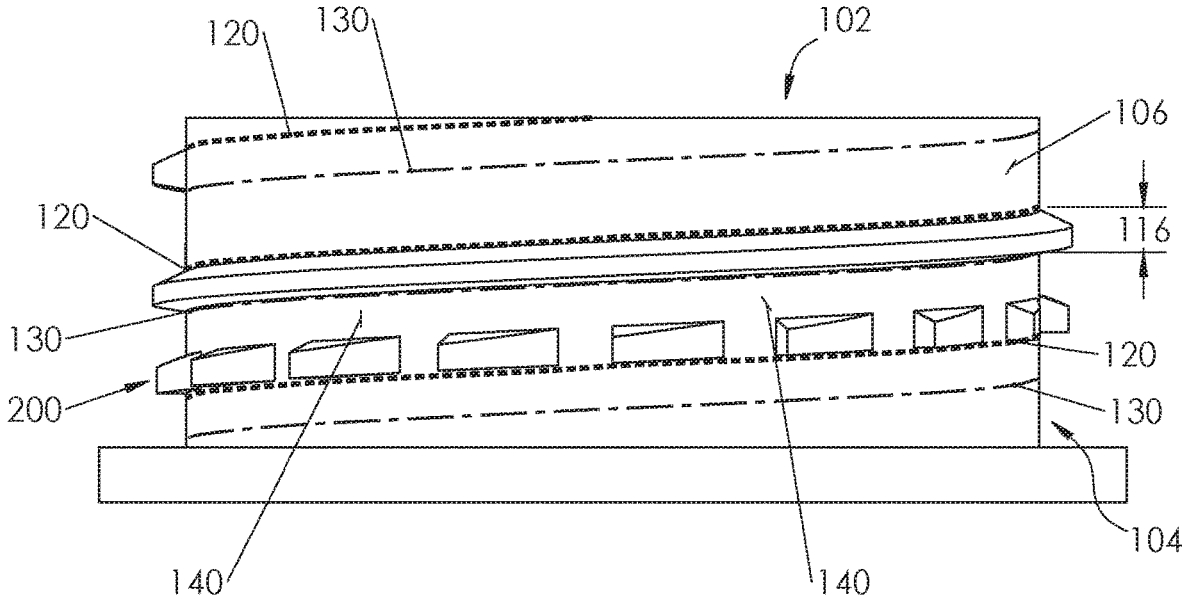
FIG. 4 is an elevation view of the embodiment of FIG. 3, rotated approximately 90 degrees.
Figure 5:
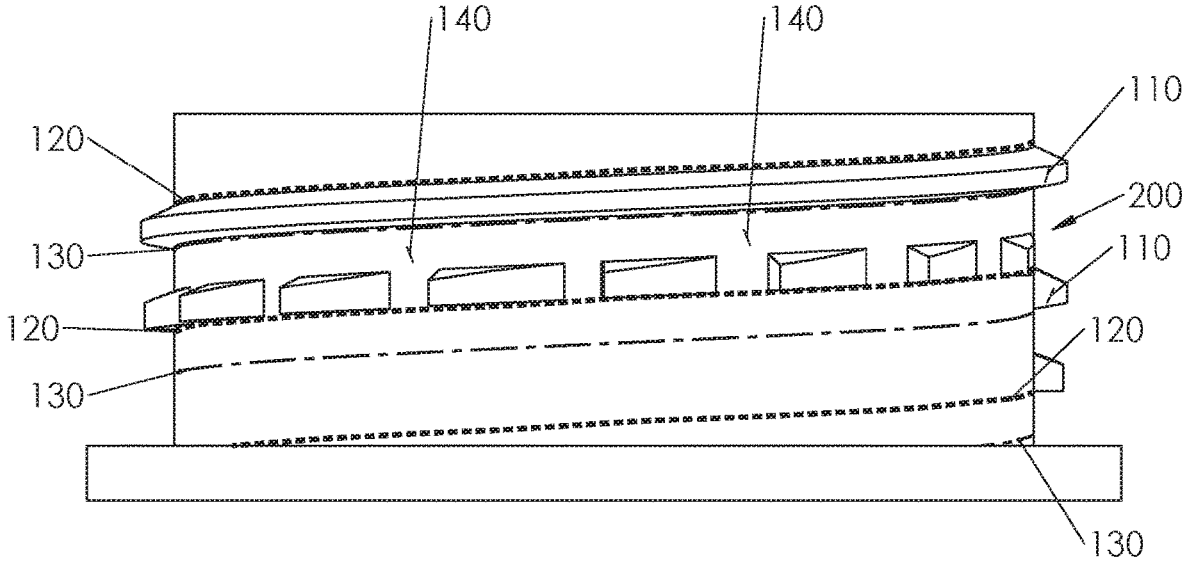
FIG. 5 is an elevation view of the embodiment of FIG. 3, rotated approximately 270 degrees.

The finish (100), with particular reference to FIG. 2, may further include at least one finish ratchet (200) having at least one finish ratchet engaging portion (210), at least one finish ratchet sloped portion (220), at least one finish ratchet depth (230), and at least one finish ratchet height (240). Ratchets (200) may lie above the imaginary superior finish thread border line (120), arising in proximity to the imaginary superior finish thread border line (120). At least one finish ratchet height (240) may extend toward the finish opening (O) less than a distance between the imaginary superior finish thread border line (120) and the imaginary inferior finish thread border line (130), thus forming a thread passage gap (140) between the plurality of finish ratchets (200) and any portion of the imaginary inferior finish thread border line (130) falling above the finish ratchets (200). The at least one finish ratchet (200) may be a plurality of finish ratchets (200), in some embodiments and the thread passage gap (140), seen well in FIG. 3, which may be sized to allow the free passage of at least one closure thread height (316), seen well in FIG. 6.

Figure 6:
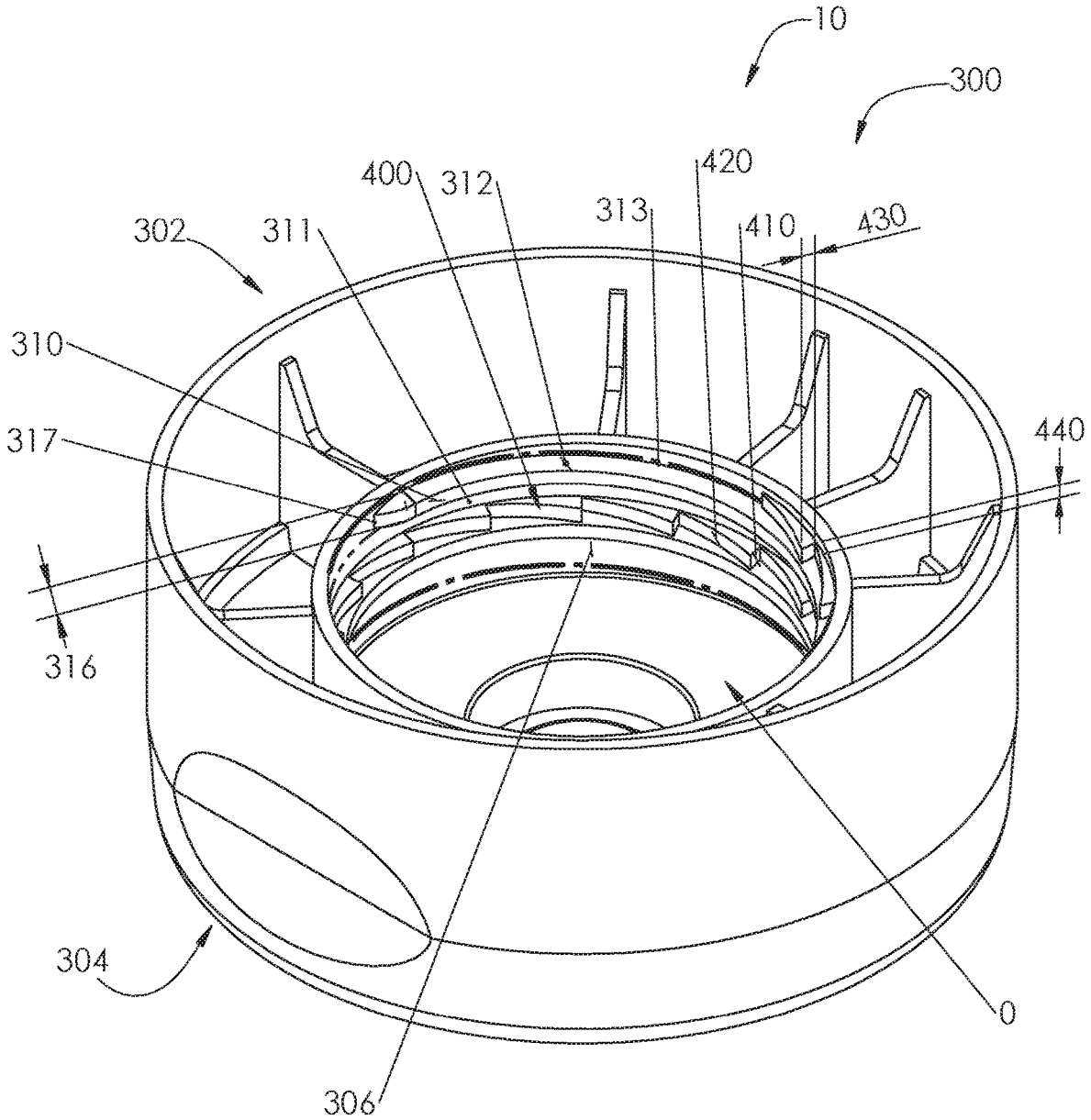
FIG. 6 is an elevated perspective view of a closure according to an embodiment of the instant invention.
Figure 7:
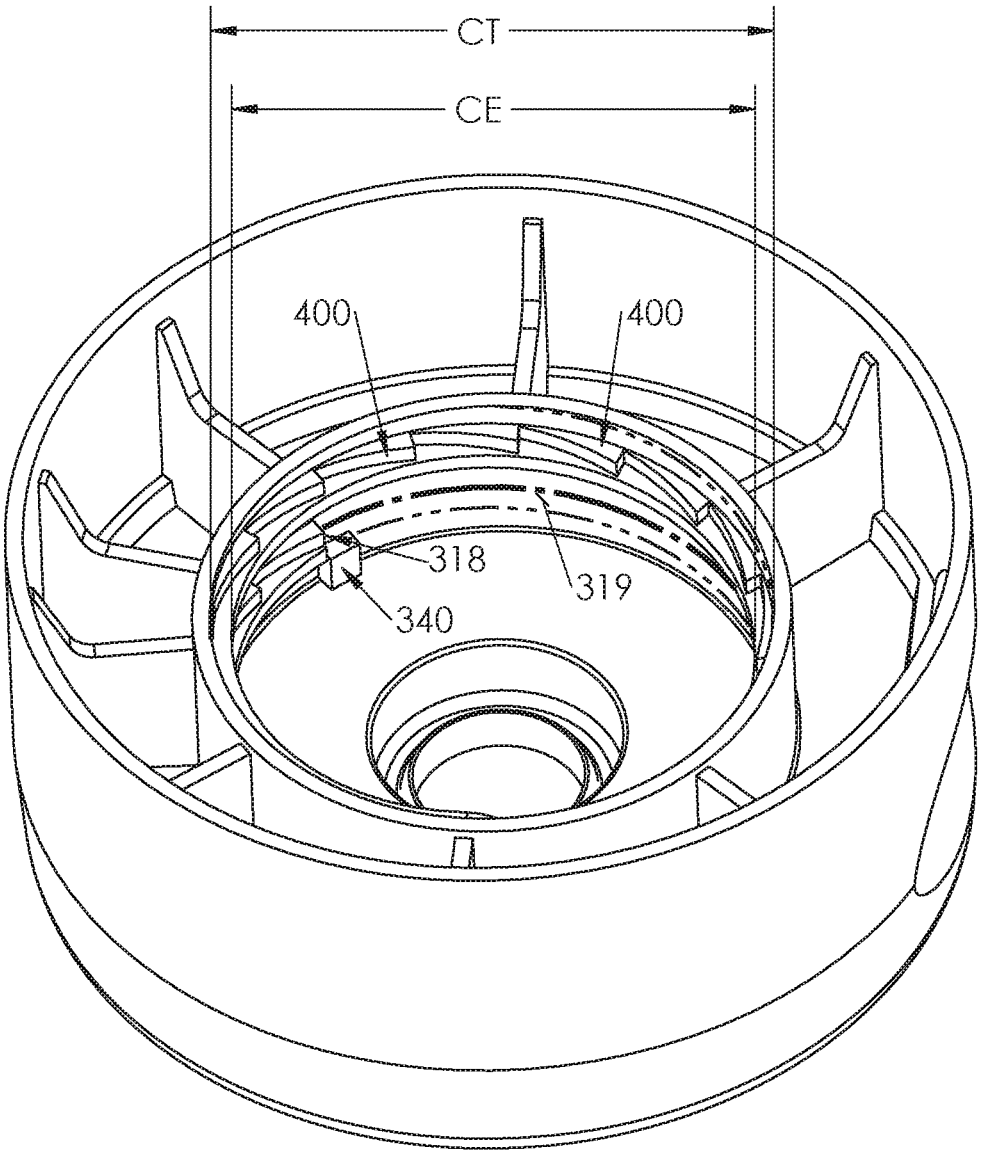
FIG. 7 is a rotated elevated perspective view of the embodiment of FIG. 5.
Figure 8:
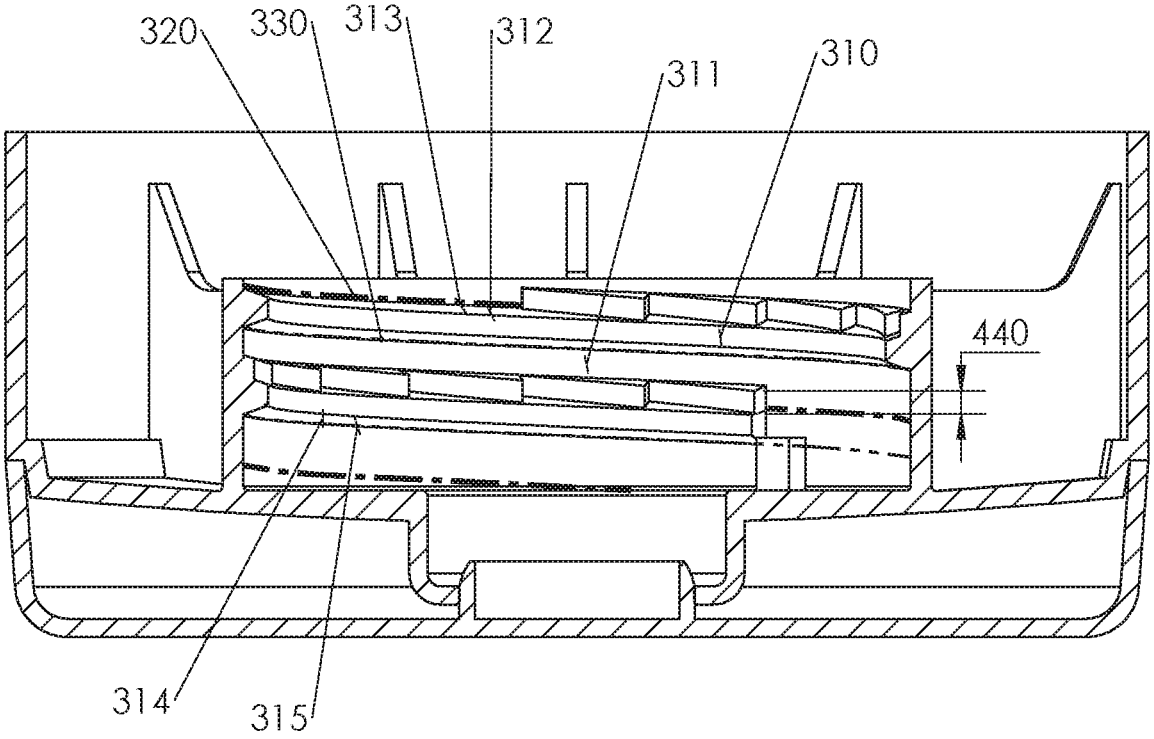
FIG. 8 is a side section view of the embodiments of FIGS. 5 and 6.
Figure 9:
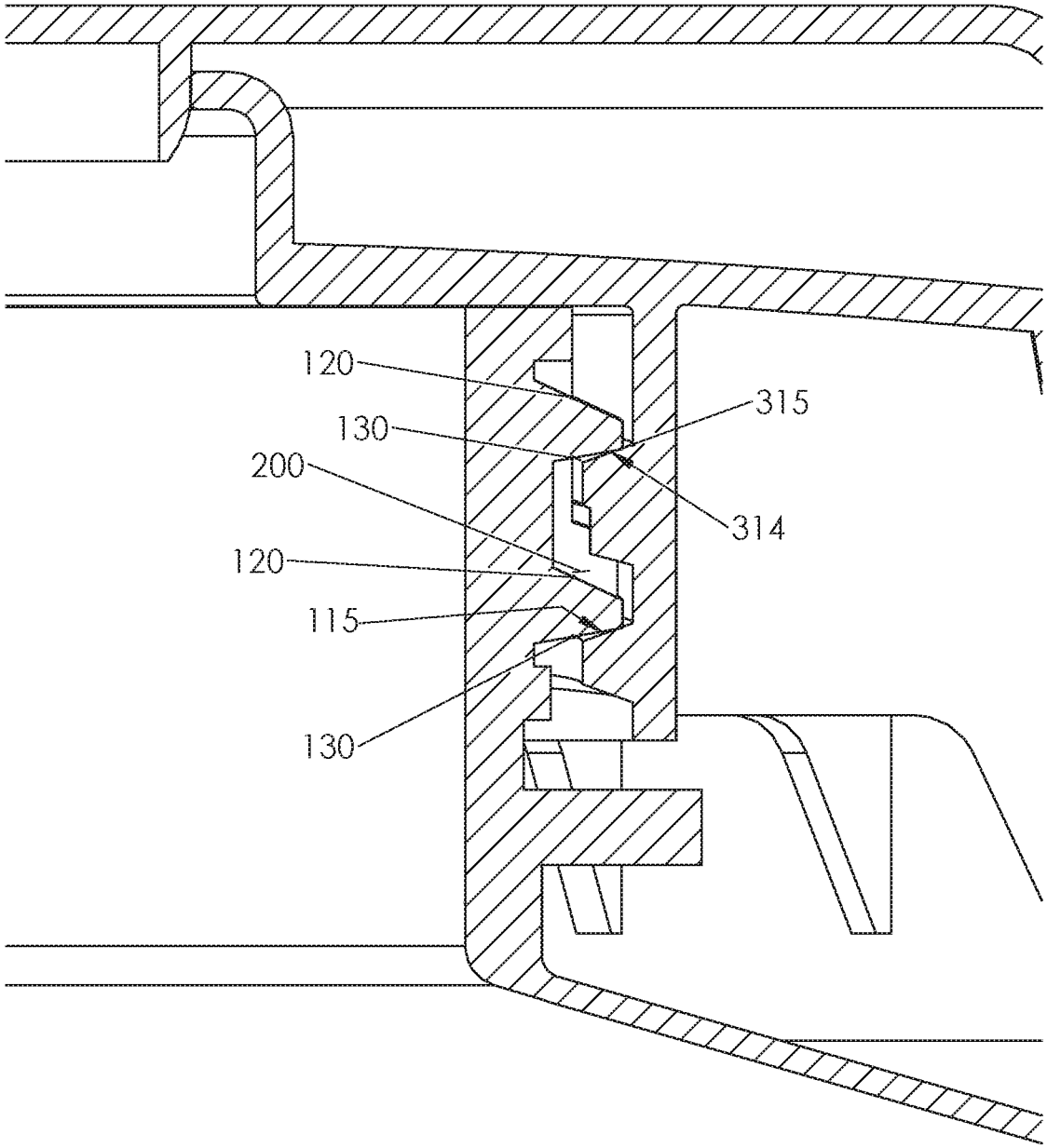
FIG. 9 is a section detail showing a portion of the engagement of the finish and closure in some embodiments of the present invention.

The system (10) may further include a closure (300), seen well in FIGS. 6-8, having a closure opening (O), a closure top (302), a closure bottom (304), a closure internal surface (306), a closure T dimension (CT), and a closure E dimension (CE), complementary to a finish (100).

There may further be a closure thread (310) having at least one closure root (311), at least one first closure thread flank (312) having a first closure thread flank base (313), at least one second closure thread flank (314) having a second closure thread flank base (315), and at least one closure thread height (316), applied to at least an arc of a circumference of the closure internal surface (306).

The closure thread (310) may have an imaginary superior closure thread border line (320) extending from the closure top (302) on the closure internal surface (306) extending through a closure thread start (317), extending along the closure thread root (311) through a closure thread termination (318) and continuously extending across any closure thread breaks (319) across the closure internal surface (306) to the closure bottom (304). Furthermore, the closure thread (310) may have an imaginary inferior closure thread border line (330), seen highlighted with a broken dark line in FIGS. 6-8, extending from the closure top (302) on the closure internal surface (306), extending through the closure thread start (317), extending along the closure thread root (311) along the second closure thread flank base (315), through the closure thread termination (318) and continuously extending across any closure thread breaks (319) across the closure internal surface (306) to the closure bottom (304).

In a series of embodiments, seen well in FIGS. 6-8, there may be at least one closure ratchet (400) having at least one closure ratchet engaging portion (410), at least one closure ratchet sloped portion (420), at least one closure ratchet depth (430) and at least one closure ratchet height (440), above the imaginary superior closure thread border line (320) and arising in proximity to the imaginary superior closure thread border line (320) and extending upwards toward the imaginary inferior closure thread border line (330). The at least one closure ratchet (400) may be a plurality of closure ratchets (400).

Figure 10:
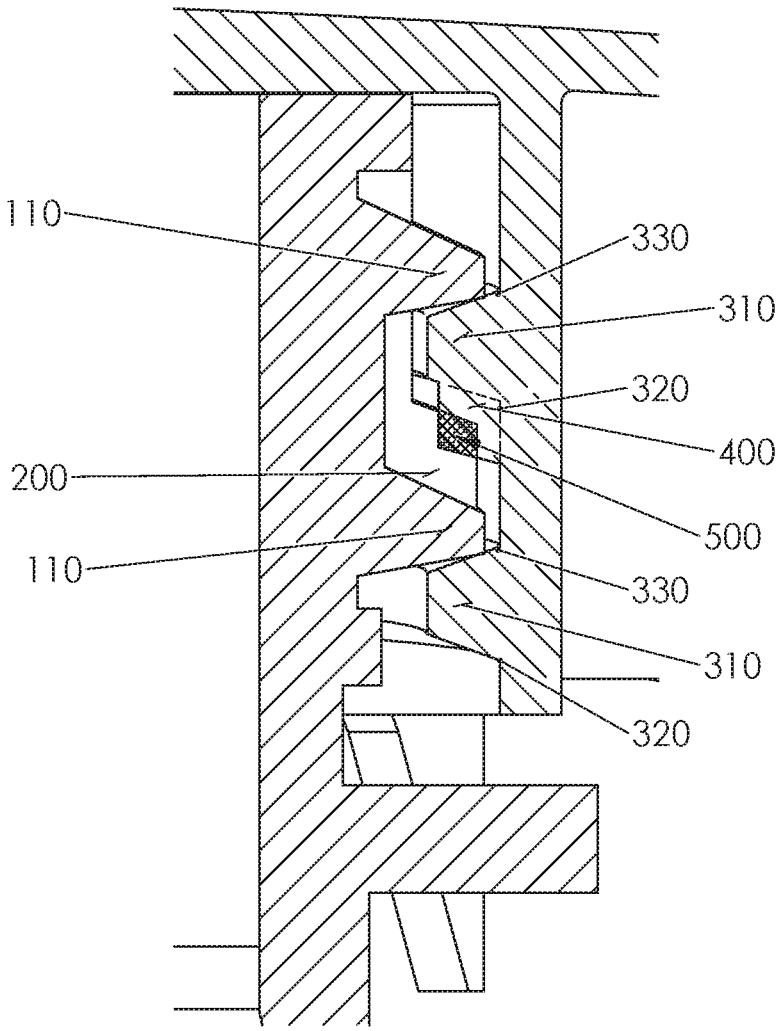
FIG. 10 is a further section detail showing a portion of the engagement of the finish and closure in some embodiments of the present invention.

In use, in many embodiments, the application of the closure (300) to the finish (100) causes at least one finish sloped portion (220) to begin overriding at least one closure ratchet sloped portion (420) until at least one finish ratchet engagement portion (210) engages at least one closure ratchet engagement portion (410) in an area of finish-closure ratchet overlap (500), seen well in FIG. 10, thereby engaging the closure (300) and the finish (100) to prevent removal of the closure (300) from the finish (100) using conventional removal methods. Such engagement is seen well in FIGS. 9-10.

Numerous variations and embodiments are possible in the system, as would be known by one skilled in the art. By way of example only, and not limitation, in some embodiments, the finish thread (110) and the closure thread (310) may be either a single continuous thread or a plurality of discontinuous threads.

In some embodiments, the finish thread (110) may make at least one full turn around the finish (100), while in others, the finish thread (110) may make at least two full turns around the finish (100). In yet other embodiments, the finish ratchets (200) are circumferentially placed around the finish (100).

Figure 11:
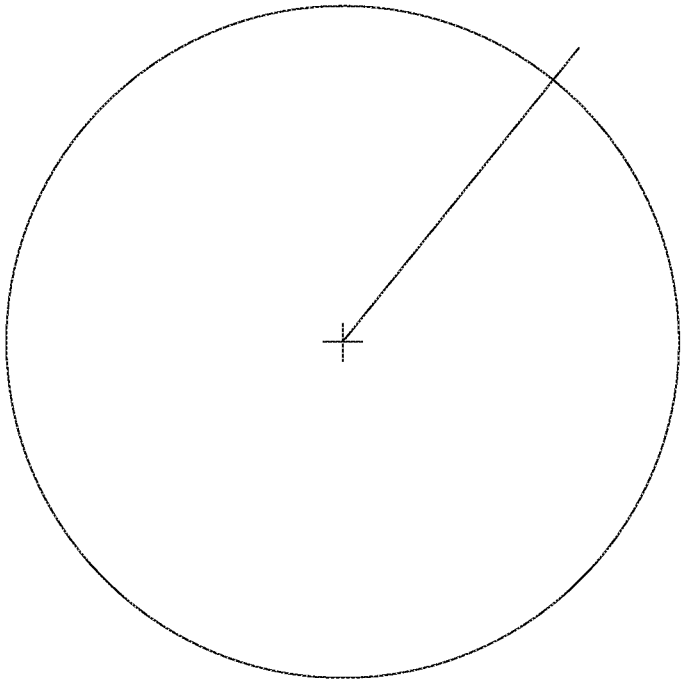
FIG. 11 is an illustration of a radial line drawn from the center of a finish to the edge of a finish.
Figure 12:
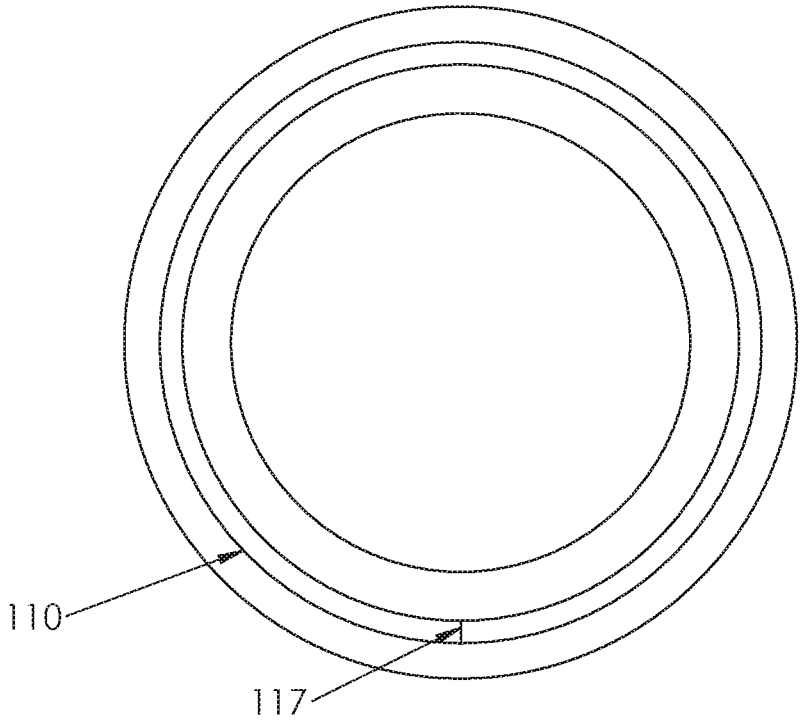
FIG. 12 is a top view of an embodiment of a finish according to the present invention.
Figure 13:
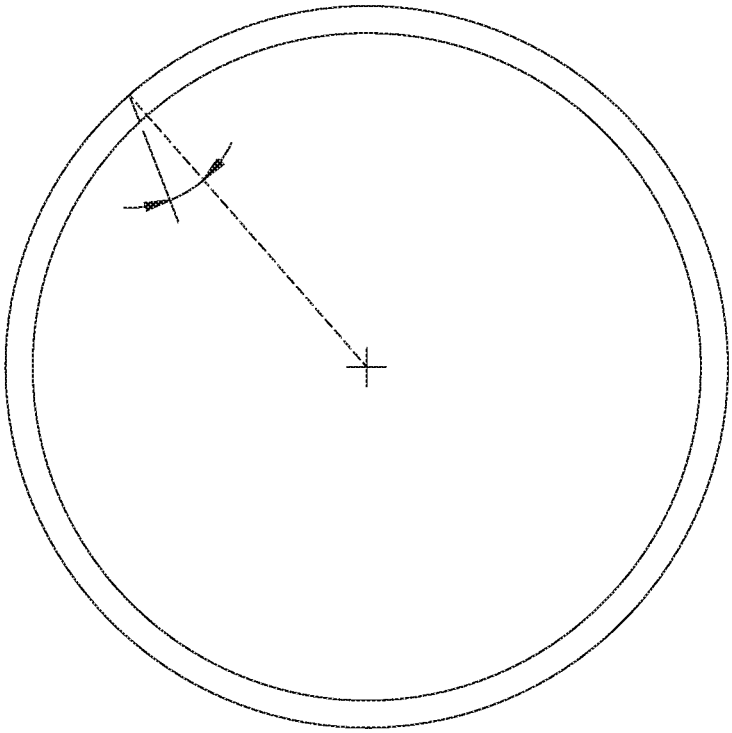
FIG. 13 is a top view of another embodiment of a finish according to the present invention.
Figure 14:
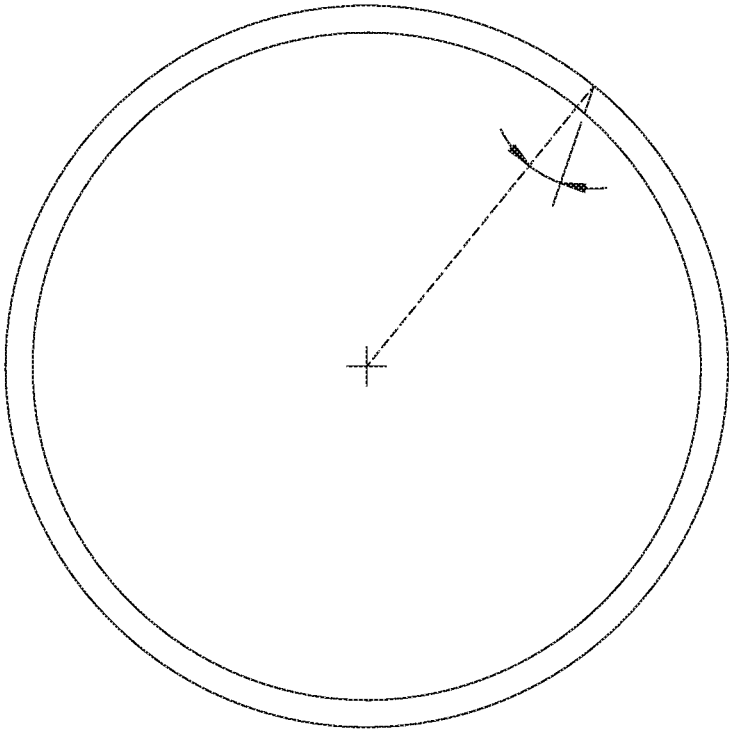
FIG. 14 is a top view of another embodiment of a finish according to the present invention.

In some embodiments, the finish thread start (117) is selected from the group of finish thread starts (117) consisting of a blunt finish thread start (117), as seen in FIG. 12, an undercut finish thread start (117), as seen in FIG. 13, and an overcut finish thread start (117) as seen in FIG. 14. For the purposes of this specification, the terms "blunt," "undercut," and "overcut" are all defined in relation to an imaginary radial line drawn outwards from a center of the finish to the outermost edge of the finish T dimension, as seen in FIG. 11. A blunt finish thread start (117) is cut approximately at a right angle to the finish thread (110), thus approximating the radial line, referencing FIG. 12. Therefore the outermost side of the finish thread start (117) is approximately the same length as the innermost side of the finish thread start (117) in a blunt cut. An undercut finish thread start (117) is cut at an angle relative to the radial line such that an outermost side of the finish thread start (117) is longer than an innermost side of the finish thread start (117) as seen in FIG. 14. An overcut finish thread start (117) is cut at an angle relative to the radial line such that an innermost side of the finish thread start (117) is longer than an innermost side of the finish thread start (117) as seen in FIG. 13.

In many embodiments, a closure thread stop (340) may be formed on the closure inner surface (306) upon application to the finish engaging the finish thread start, thereby limiting a tightening movement or preventing over-torqueing of the finish thread (110) on the closure (300). For example, using an undercut thread start (117) with an opposing closure stop (340) can prevent the closure from being applied beyond the intended stopping point.

The novel placement of the finish ratchets allows the finish ratchets (200) and the closure ratchets (400) to make early engagement, sometimes with only a fractional turn of the closure (300) on the finish (100). In some embodiments, a first finish ratchet engaging portion (210) lies between ten and thirty-five radial degrees of the finish thread start (117), while in others, a first finish ratchet engaging portion (210) may lie within ninety radial degrees of the finish thread start (117). In yet other embodiments, a first finish ratchet engaging portion (210) lies within 270 radial degrees of the finish thread start (117). In both cases, the finish is defined as having a circumference of 360 radial degrees, so the first ratchet engaging portion (210) may, in these embodiments, be not more than one-quarter of a circumference beyond the finish thread start (117).

In other embodiments, a first closure ratchet engaging portion (410) lies within five closure thread heights (316) of the closure thread start (317), while in others, a first closure ratchet engaging portion (410) may lie within ten closure thread heights (316) of the closure thread start (317). Such close approximation of the ratchets (200, 400) to the thread starts (117, 417) allows early engagement of the ratchets (200, 400). Thus, even a partially threaded closure (300) may be effectively "locked" to a finish (100).

The system may be fabricated with a wide variety of shell designs, and even openable caps, by way of example only, in some embodiments, a "flip top," on the closure. There may be single shell designs and double shell designs, where an outer "skirt" forms a part of the closure (300). By way of example only, and not limitation, the closure illustrated in FIGS. 6-8 herein will immediately be recognized by those skilled in the art as a "double shell" or "skirted" design, however it is to be emphasized that the system (10) taught herein is applicable to any shell structure or design.

In some embodiments, all finish ratchets (200) may be located between two adjoining turns of the imaginary superior finish thread border line (120), and in other embodiments, the finish ratchets (200) may be all located between a portion of the imaginary superior finish thread border line (120) and a portion of an immediately adjacent imaginary inferior finish thread border line (130).

In some embodiments, at least one finish ratchet (200) arises from and is attached to the first finish thread flank (112), while in others, at least one finish ratchet (200) is spaced apart from the first finish thread flank (112).

It is not necessary that the at least one finish ratchet height (240) be a single height. In some embodiments, the at least one finish ratchet height (240) may at least two finish ratchet heights (240), a first finish ratchet height (240) having a first finish ratchet depth (230) causing it to be engageable with at least one closure ratchet (400) in an area of finish-closure ratchet overlap (500), seen in FIG. 10, and a second finish ratchet height (240) having a second finish ratchet depth (230), lower than the first finish ratchet depth (230) allowing a free passage of all closure ratchets (400). The second finish ratchet height may even be an area of no height, that is, the second finish ratchet height (240) may simply be an area flush with the finish external surface (106).

In another series of embodiments, and with reference to FIGS. 1-14 as previously described, a bottle finish and closure system (10) can include a bottle finish (100) having a finish opening (O), a finish top (102), a finish bottom (104), a finish external surface (106), a finish T dimension (FT), and a finish E dimension (FE). Such a finish (100) may be complementary to a bottle closure (300), further comprising a finish thread (110) having at least one finish thread root (111), at least one first finish thread flank (112) having a first finish thread flank base (113), at least one second finish thread flank (114) having a second finish thread flank base (115), and at least one finish thread height (116), applied to at least an arc of a circumference of the finish external surface (106).

The finish thread (110) may have an imaginary superior finish thread border line (120) extending from the finish top (102) on the finish external surface (106), extending through a finish thread start (117), extending along the finish thread root (111) along the first finish thread flank base (113), through a finish thread termination (118), and continuously extending across any finish thread breaks (119) across the finish external surface (106) to the finish bottom (104).

There may be an imaginary inferior finish thread border line (130) extending from the finish top (102) on the finish external surface (106), extending through the finish thread start (117), extending along the finish thread root (111) along the second finish thread flank base (115) and through the finish thread termination (118), continuously extending across any finish thread breaks (119) across the finish external surface (106) to the finish bottom (104).

In many embodiments, at least one finish ratchet (200) may have at least one finish ratchet engaging portion (210), at least one finish ratchet sloped portion (220), at least one finish ratchet depth (230), and at least one finish ratchet height (240), above the imaginary superior finish thread border line (120). Such a finish ratchet (200) may arise in proximity to the imaginary superior finish thread border line (120) and have at least one finish ratchet height (240) extending towards the finish opening (O) less than a distance between the imaginary superior finish thread border line (120) and the imaginary inferior finish thread border line (130), thus forming a thread passage gap (140) between the plurality of finish ratchets (200) and any portion of the imaginary inferior finish thread border line (130) falling above the finish ratchets (200). The thread passage gap (140) may sized to allow the free passage of at least one closure thread height (316).

There may be a closure (300) having a closure opening (O), a closure top (302), a closure bottom (304), a closure internal surface (306), a closure T dimension (CT), and a closure E dimension (CE), complementary to a finish (100). Such a closure may further include a closure thread (310) having at least one closure root (311), at least one first closure thread flank (312) having a first closure thread flank base (313), at least one second closure thread flank (314) having a second closure thread flank base (315), and at least one closure thread height (316), applied to at least an arc of a circumference of the closure internal surface (306).

The closure thread (310) may have an imaginary superior closure thread border line (320) extending from the closure top (302) on the closure internal surface (306) extending through a closure thread start (317), extending along the closure thread root (311) through a closure thread termination (318) and continuously extending across any closure thread breaks (319) across the closure internal surface (306) to the closure bottom (304). Furthermore, the closure thread (310) may have an imaginary inferior closure thread border line (330) extending from the closure top (302) on the closure internal surface (306), extending through the closure thread start (317), extending along the closure thread root (311) along the second closure thread flank base (315), through the closure thread termination (318) and continuously extending across any closure thread breaks (319) across the closure internal surface (306) to the closure bottom (304).

In many embodiments, at least one closure ratchet (400) is seen, having at least one closure ratchet engaging portion (410), at least one closure ratchet sloped portion (420), at least one closure ratchet depth (430) and at least two finish ratchet heights (240), a first finish ratchet height (240) having a first finish ratchet depth (230) causing it to be engageable with at least one closure ratchet (400), and a second finish ratchet height (240) having a second finish ratchet depth (230) allowing a free passage of all closure ratchets (400) above the imaginary superior closure thread border line (320). Such a ratchet (400) may arise in proximity to the imaginary superior closure thread border line (320) and extending upwards toward the imaginary inferior closure thread border line (330). In use, the application of the closure (300) to the finish (100) engages the at least one closure ratchet (400) with at least one finish ratchet (200), thereby engaging the closure (300) and the finish (100) to prevent removal of the closure (300) from the finish (100) using conventional removal methods.

In yet another series of embodiments, the novel design of the finish (100) allows use as part of a system in which, by using a conventional closure (300), a system having a freely removable closure (300) may be created. This, along with the non-removable finish and closure system (10) disclosed above, gives a manufacturer unique options. For example, as would be recognized by one skilled in the art, a manufacturer could fill a plurality of bottles having the finish (100) described above, closing some with the closure (300) described above, and closing others with a conventional, i.e., ratchetless closure (300). Thus, while using the same bottles having the same bottle finishes (100), both non-removable closure (300) and removable closure (300) products can be produced on the same, or similar, bottling lines.

Such a series of embodiments could include a bottle finish and closure system (10) having a bottle finish (100) having a finish opening (O), a finish top (102), a finish bottom (104), a finish external surface (106), a finish T dimension (FT), and a finish E dimension (FE), complementary to a bottle closure (300). These could further include a finish thread (110) having at least one finish thread root (111), at least one first finish thread flank (112) having a first finish thread flank base (113), at least one second finish thread flank (114) having a second finish thread flank base (115), and at least one finish thread height (116), applied to at least an arc of a circumference of the finish external surface (106).

The finish thread (110) may have an imaginary superior finish thread border line (120) extending from the finish top (102) on the finish external surface (106), extending through a finish thread start (117), extending along the finish thread root (111) along the first finish thread flank base (113), through a finish thread termination (118), and continuously extending across any finish thread breaks (119) across the finish external surface (106) to the finish bottom (104).

The finish thread may also have an imaginary inferior finish thread border line (130) extending from the finish top (102) on the finish external surface (106), extending through the finish thread start (117), extending along the finish thread root (111) along the second finish thread flank base (115) and through the finish thread termination (118), continuously extending across any finish thread breaks (119) across the finish external surface (106) to the finish bottom (104).

There may be at least one finish ratchet (200) having at least one finish ratchet engaging portion (210), at least one finish ratchet sloped portion (220), at least one finish ratchet depth (230), and at least one finish ratchet height (240), above the imaginary superior finish thread border line (120) arising in proximity to the imaginary superior finish thread border line (120) and wherein the at least one finish ratchet height (240) extends toward the finish opening (O) less than a distance between the imaginary superior finish thread border line (120) and the imaginary inferior finish thread border line (130), thus forming a thread passage gap (140) between the plurality of finish ratchets (200) and any portion of the imaginary inferior finish thread border line (130) falling above the finish ratchets (200).

There may be a closure (300) having a closure opening (O), a closure top (302), a closure bottom (304), a closure internal surface (306), a closure T dimension (CT), and a closure E dimension (CE), complementary to a finish (100).

Such a closure (300) may further have a closure thread (310) having at least one closure root (311), at least one first closure thread flank (312) having a first closure thread flank base (313), at least one second closure thread flank (314) having a second closure thread flank base (315), and at least one closure thread height (316), applied to at least an arc of a circumference of the closure internal surface (306).

The closure thread (310) may have an imaginary superior closure thread border line (320) extending from the closure top (302) on the closure internal surface (306) extending through a closure thread start (317), extending along the closure thread root (311) through a closure thread termination (318) and continuously extending across any closure thread breaks (319) across the closure internal surface (306) to the closure bottom (304). Furthermore, the closure thread (310) may have an imaginary inferior closure thread border line (330) extending from the closure top (302) on the closure internal surface (306), extending through the closure thread start (317), extending along the closure thread root (311) along the second closure thread flank base (315), through the closure thread termination (318) and continuously extending across any closure thread breaks (319) across the closure internal surface (306) to the closure bottom (304).

The thread passage gap (140) may be sized to allow the free passage of at least one closure thread height (316), and the closure (300), being ratchetless, or having ratchets with a closure ratchet height (440) insufficient to engage the finish ratchets (200), creates an application of the closure (300) to the finish (100) that would be bidirectionally engageable to reversible open and close the closure (300) and finish (100) system (10).

Numerous alterations, modifications, and variations of the preferred embodiments disclosed herein will be apparent to those skilled in the art and they are all anticipated and contemplated to be within the spirit and scope of the disclosed system (10). For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the system (10) are described herein, it is to be understood that the practice of such additional modifications and variations and the equivalents thereof, are within the spirit and scope of the system (10) as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A bottle finish and closure system (10) comprising:

a. a bottle finish (100) having a finish opening (O), a finish top (102), a finish bottom (104), a finish external surface (106), a finish T dimension (FT), and a finish E dimension (FE), complementary to a bottle closure (300), further comprising a finish thread (110) having at least one finish thread root (111), at least one first finish thread flank (112) having a first finish thread flank base (113), at least one second finish thread flank (114) having a second finish thread flank base (115), and at least one finish thread height (116), applied to at least an arc of a circumference of the finish external surface (106), the finish thread (110) has an imaginary superior finish thread border line (120) extending from the finish top (102) on the finish external surface (106), extending through a finish thread start (117), extending along the finish thread root (111) along the first finish thread flank base (113), through a finish thread termination (118), and continuously extending across any finish thread breaks (119) across the finish external surface (106) to the finish bottom (104);

and an imaginary inferior finish thread border line (130) extending from the finish top (102) on the finish external surface (106), extending through the finish thread start (117), extending along the finish thread root (111) along the second finish thread flank base (115) and through the finish thread termination (118), continuously extending across any finish thread breaks (119) across the finish external surface (106) to the finish bottom (104); and a plurality of finish ratchets (200) having at least one finish ratchet engaging portion (210), at least one finish ratchet sloped portion (220), at least one finish ratchet depth (230), and at least one finish ratchet height (240), above the imaginary superior finish thread border line (120) arising in proximity to the imaginary superior finish thread border line (120) and wherein the at least one finish ratchet height (240) extends toward the finish opening (O) less than a distance between the imaginary superior finish thread border line (120) and the imaginary inferior finish thread border line (130), thus forming a thread passage gap (140) between the plurality of finish ratchets (200) and any portion of the imaginary inferior finish thread border line (130) falling above the finish ratchets (200), b. a closure (300) having a closure opening (O), a closure top (302), a closure bottom (304), a closure internal surface (306), a closure T dimension (CT), and a closure E dimension (CE), complementary to a finish (100), further comprising, a closure thread (310) having at least one closure root (311), at least one first closure thread flank (312) having a first closure thread flank base (313), at least one second closure thread flank (314) having a second closure thread flank base (315), and at least one closure thread height (316), applied to at least an arc of a circumference of the closure internal surface (306), and the closure thread (310) has an imaginary superior closure thread border line (320) extending from the closure top (302) on the closure internal surface (306) extending through a closure thread start (317), extending along the closure thread root (311) through a closure thread termination (318) and continuously extending across any closure thread breaks (319) across the closure internal surface (306) to the closure bottom (304); and an imaginary inferior closure thread border line (330) extending from the closure top (302) on the closure internal surface (306), extending through the closure thread start (317), extending along the closure thread root (311) along the second closure thread flank base (315), through the closure thread termination (318) and continuously extending across any closure thread breaks (319) across the closure internal surface (306) to the closure bottom (304); and a plurality of closure ratchets (400) having at least one closure ratchet engaging portion (410), at least one closure ratchet sloped portion (420), at least one closure ratchet depth (430) and at least one closure ratchet height (440) above the imaginary superior closure thread border line (320) and arising in proximity to the imaginary superior closure thread border line (320) and extending upwards toward the imaginary inferior closure thread border line (330); wherein c. the thread passage gap (140) is sized to allow the free passage of at least one closure thread height (316), and d. the application of the closure (300) to the finish (100) engages at least one closure ratchet (400) with at least one finish ratchet (200), thereby engaging the closure (300) and the finish (100) to prevent removal of the closure (300) from the finish (100).

2. The system according to claim 1, wherein the finish thread (110) and the closure thread (310) are both selected from the group of threads consisting of single continuous thread and a plurality of discontinuous threads.

3. The system according to claim 1, wherein the at least one finish ratchet (200) is a plurality of finish ratchets (200).

4. The system according to claim 1, wherein the at least one closure ratchet (400) is a plurality of closure ratchets (400).

5. The system according to claim 1, wherein the finish thread (110) makes at least one full turn around the finish (100).

6. The system according to claim 1, wherein the finish thread (110) makes at least two full turns around the finish (100).

7. The system according to claim 1, wherein the finish ratchets (200) are circumferentially present around the finish (100).

8. The system according to claim 1, wherein the finish thread start (117) is selected from the group of finish thread starts (17) consisting of a blunt finish thread start (117), an undercut finish thread start (117) and an overcut finish thread start (117).

9. The system according to claim 1, wherein a closure thread stop (340) is formed on the closure inner surface (306) and the stop (340) limits a tightening movement of the finish thread (110) on the closure (300).

10. The system according to claim 1, wherein a first finish ratchet engaging portion (210) lies between ten and thirty-five radial degrees of the finish thread start (117).

11. The system according to claim 1, wherein a first finish ratchet engaging portion (210) lies within ninety radial degrees of the finish thread start (117).

12. The system according to claim 1, wherein the closure is fabricated with a shell design selected from the group of shell designs consisting of a single shell design and a double shell design.

13. The system according to claim 1, wherein all finish ratchets (200) are located between two adjoining turns of the imaginary superior finish thread border line (120).

14. The system according to claim 1, wherein the finish ratchets (200) are all located between a portion of the imaginary superior finish thread border line (120) and a portion of an immediately adjacent imaginary inferior finish thread border line (130).

15. The system according to claim 1, wherein at least one finish ratchet (200) arises from and is attached to the first finish thread flank (112).

16. The system according to claim 1, wherein at least one finish ratchet (200) is spaced apart from the first finish thread flank (112).

17. The system according to claim 1, wherein the at least one finish ratchet height (240) is at least two finish ratchet heights (240), a first finish ratchet height (240) having a first finish ratchet depth (230) causing it to be engageable with at least one closure ratchet (400), and a second finish ratchet height (240) having a second finish ratchet depth (230) allowing a free passage of all closure ratchets (400).

18. The system according to claim 17, wherein the second finish ratchet height (240) is an area flush with the finish external surface (106).

19. A bottle finish and closure system (10) comprising:

a. a bottle finish (100) having a finish opening (O), a finish top (102), a finish bottom (104), a finish external surface (106), a finish T dimension (FT), and a finish E dimension (FE), complementary to a bottle closure (300), further comprising a finish thread (110) having at least one finish thread root (111), at least one first finish thread flank (112) having a first finish thread flank base (113), at least one second finish thread flank (114) having a second finish thread flank base (115), and at least one finish thread height (116), applied to at least an arc of a circumference of the finish external surface (106), the finish thread (110) has an imaginary superior finish thread border line (120) extending from the finish top (102) on the finish external surface (106), extending through a finish thread start (117), extending along the finish thread root (111) along the first finish thread flank base (113), through a finish thread termination (118), and continuously extending across any finish thread breaks (119) across the finish external surface (106) to the finish bottom (104);

and an imaginary inferior finish thread border line (130) extending from the finish top (102) on the finish external surface (106), extending through the finish thread start (117), extending along the finish thread root (111) along the second finish thread flank base (115) and through the finish thread termination (118), continuously extending across any finish thread breaks (119) across the finish external surface (106) to the finish bottom (104); and a plurality of finish ratchets (200) having at least one finish ratchet engaging portion (210), at least one finish ratchet sloped portion (220), at least one finish ratchet depth (230), and at least one finish ratchet height (240), above the imaginary superior finish thread border line (120) arising in proximity to the imaginary superior finish thread border line (120) and wherein the at least one finish ratchet height (240) extends toward the finish opening (O) less than a distance between the imaginary superior finish thread border line (120) and the imaginary inferior finish thread border line (130), thus forming a thread passage gap (140) between the plurality of finish ratchets (200) and any portion of the imaginary inferior finish thread border line (130) falling above the finish ratchets (200), b. a closure (300) having a closure opening (O), a closure top (302), a closure bottom (304), a closure internal surface (306), a closure T dimension (CT), and a closure E dimension (CE), complementary to a finish (100), further comprising, a closure thread (310) having at least one closure root (311), at least one first closure thread flank (312) having a first closure thread flank base (313), at least one second closure thread flank (314) having a second closure thread flank base (315), and at least one closure thread height (316), applied to at least an arc of a circumference of the closure internal surface (306), and the closure thread (310) has an imaginary superior closure thread border line (320) extending from the closure top (302) on the closure internal surface (306) extending through a closure thread start (317), extending along the closure thread root (311) through a closure thread termination (318) and continuously extending across any closure thread breaks (319) across the closure internal surface (306) to the closure bottom (304); and an imaginary inferior closure thread border line (330) extending from the closure top (302) on the closure internal surface (306), extending through the closure thread start (317), extending along the closure thread root (311) along the second closure thread flank base (315), through the closure thread termination (318) and continuously extending across any closure thread breaks (319) across the closure internal surface (306) to the closure bottom (304); and a plurality of closure ratchets (400) having at least one closure ratchet engaging portion (410), at least one closure ratchet sloped portion (420), at least one closure ratchet depth (430) and at least two finish ratchet heights (240), a first finish ratchet height (240) having a first finish ratchet depth (230) causing it to be engageable with at least one closure ratchet (400), and a second finish ratchet height (240) having a second finish ratchet depth (230) allowing a free passage of all closure ratchets (400) above the imaginary superior closure thread border line (320) and arising in proximity to the imaginary superior closure thread border line (320) and extending upwards toward the imaginary inferior closure thread border line (330); wherein c. the thread passage gap (140) is sized to allow the free passage of the at least one closure thread height (316), and d. the application of the closure (300) to the finish (100) engages at least one closure ratchet (300) with at least one finish ratchet (200), thereby engaging the closure (300) and the finish (100) to prevent removal of the closure (300) from the finish (100).

20. A bottle finish and closure system (10) comprising:

a. a bottle finish (100) having a finish opening (O), a finish top (102), a finish bottom (104), a finish external surface (106), a finish T dimension (FT), and a finish E dimension (FE), complementary to a bottle closure (300), further comprising a finish thread (110) having at least one finish thread root (111), at least one first finish thread flank (112) having a first finish thread flank base (113), at least one second finish thread flank (114) having a second finish thread flank base (115), and at least one finish thread height (116), applied to at least an arc of a circumference of the finish external surface (106), the finish thread (110) may have an imaginary superior finish thread border line (120) extending from the finish top (102) on the finish external surface (106), extending through a finish thread start (117), extending along the finish thread root (111) along the first finish thread flank base (113), through a finish thread termination (118), and continuously extending across any finish thread breaks (119) across the finish external surface (106) to the finish bottom (104);

and an imaginary inferior finish thread border line (130) extending from the finish top (102) on the finish external surface (106), extending through the finish thread start (117), extending along the finish thread root (111) along the second finish thread flank base (115) and through the finish thread termination (118), continuously extending across any finish thread breaks (119) across the finish external surface (106) to the finish bottom (104); and a plurality of finish ratchets (200) having at least one finish ratchet engaging portion (210), at least one finish ratchet sloped portion (220), at least one finish ratchet depth (230), and at least one finish ratchet height (240), above the imaginary superior finish thread border line (120) arising in proximity to the imaginary superior finish thread border line (120) and wherein the at least one finish ratchet height (240) extends toward the finish opening (O) less than a distance between the imaginary superior finish thread border line (120) and the imaginary inferior finish thread border line (130), thus forming a thread passage gap (140) between the plurality of finish ratchets (200) and any portion of the imaginary inferior finish thread border line (130) falling above the finish ratchets (200), b. a closure (300) having a closure opening (O), a closure top (302), a closure bottom (304), a closure internal surface (306), a closure T dimension (CT), and a closure E dimension (CE), complementary to a finish (100), further comprising, a closure thread (310) having at least one closure root (311), at least one first closure thread flank (312) having a first closure thread flank base (313), at least one second closure thread flank (314) having a second closure thread flank base (315), and at least one closure thread height (316), applied to at least an arc of a circumference of the closure internal surface (306), and the closure thread (310) has an imaginary superior closure thread border line (320) extending from the closure top (302) on the closure internal surface (306) extending through a closure thread start (317), extending along the closure thread root (311) through a closure thread termination (318) and continuously extending across any closure thread breaks (319) across the closure internal surface (306) to the closure bottom (304); and an imaginary inferior closure thread border line (330) extending from the closure top (302) on the closure internal surface (306), extending through the closure thread start (317), extending along the closure thread root (311) along the second closure thread flank base (315), through the closure thread termination (318) and continuously extending across any closure thread breaks (319) across the closure internal surface (306) to the closure bottom (304); and c. the thread passage gap (140) is sized to allow the free passage of at least one closure thread height (316), and d. the application of the closure (300) to the finish (100) is bidirectionally engageable to reversible open and close the closure (300) and finish (100) system (10).

21. The system according to claim 1, wherein a first finish ratchet engaging portion (210) lies within 270 radial degrees of the finish thread start (117).

* * * * *